United States Patent [19]

Jan

[11] Patent Number: 4,601,456

[45] Date of Patent: Jul. 22, 1986

[54] APPARATUS FOR FORMING A CONCRETE STRUCTURE

[76] Inventor: Shaw G. Jan, No. 64 Chung Lin Li, Da Lin Cheng, Chia Yi Hsien, Taiwan

[21] Appl. No.: 711,703

[22] Filed: Mar. 14, 1985

[51] Int. Cl.[4] ..... E04G 9/08

[52] U.S. Cl. ..... 249/91; 249/14; 249/29; 249/39; 249/47; 249/49; 249/157; 249/189; 249/192; 249/194

[58] Field of Search ..... 249/18, 20, 27, 28, 249/29, 50, 112, 157, 189, 33, 40, 44, 47, 48, 84, 91, 49, 155, 190, 192, 14, 17, 39, 42, 83, 194, 169

[56] References Cited

U.S. PATENT DOCUMENTS

| | | | |
|---|---|---|---|
| 869,036 | 10/1907 | Wood | 249/189 |
| 1,289,083 | 12/1918 | Banks | 249/189 |
| 3,245,648 | 4/1966 | Johansson et al. | 249/20 |
| 3,497,579 | 2/1970 | Barron | 249/20 |
| 3,591,123 | 7/1971 | Edwards | 249/20 |
| 4,288,277 | 9/1981 | Siilats | 249/180 |

FOREIGN PATENT DOCUMENTS

| | | | |
|---|---|---|---|
| 648707 | 2/1979 | U.S.S.R. | 249/20 |

*Primary Examiner*—Jay H. Woo
*Assistant Examiner*—James C. Housel
*Attorney, Agent, or Firm*—Morgan, Finnegan Pine Foley & Lee

[57] ABSTRACT

An apparatus for forming concrete structures which is comprised of size variable form units that can be erected in various forms by incorporating telescopic struts, telescopic batters with fastening means including spring catch members and spring latch members that can be interengaged and disengaged easily. Two members one of which is inclined relative to the other can be connected with a connecting means including a toothed member and a spring engaging member having a toothed face. Tiles can be adhered to the molded concrete structure simultaneously with the molding.

19 Claims, 36 Drawing Figures

APPARATUS FOR FORMING A CONCRETE STRUCTURE

BACKGROUND OF THE INVENTION

This invention relates to an improved apparatus for forming a concrete structure which includes size variable form units and spring fastening means for easily fastening the form units to struts, batters etc. This is an improvement made on the conventional apparatus which includes dimension invariable mold panels, struts, batters and brace members.

SUMMARY OF THE INVENTION

An object of the invention is to provide an improved apparatus for forming a concrete structure which includes size variable form units so that it can be set up into different forms.

Another object of the invention is to provide an apparatus for forming a concrete structure which includes fastening means which can be interengaged and disengaged easily so that forms can be erected or dismantled easily.

A further object of the invention is to provide an apparatus for forming a concrete structure by which tiles can be arranged adjacent to the surface of the form set-up so that tiles are adhered to the molded structure simultaneously with the molding.

These and other objects can be achieved in accordance with the invention through the provision of an apparatus which comprises a plurality of telescopic members to be assembled into a size variable form unit, each of which includes a first member, a second member slideably inserted into said first member, and means for levelling the surface of the telescopic member. Said means includes a spool on which is wound a flexible sheet member attached to the first member, one end of the sheet member being affixed to one end of the second member. The sheet member is unwound and laid flat on one surface of the first member when the second member is drawn outward so that the surface of said first member is flush with the surface of said second member.

The apparatus further includes telescopic batters for supporting the telescopic members. Each batter has two channel bars one inserted in the other and means for fixing one bar to another when the batter is adjusted to a predetermined length.

The apparatus further includes telescopic strut members for supporting the telescopic members. Each strut member includes an upper and a lower elongated tubular members, one inserted in the other, a top member connected to the top side of the upper tubular member and having a support top plate, and a height adjusting means for the strut member.

The apparatus still further includes means for fastening the telescopic member to the batter. Said means includes a spring catch member and a spring latch member which can be engaged or disengaged from one another by pushing or pulling.

The apparatus still further includes a framework for arranging tiles over the surface of the form. The framework is constituted of a horizontal base strip having a first U-shaped groove extending lengthwise and fixed on the floor adjacent the form, a plurality of vertical strips set upright on the base strip, the vertical strip having a U-shaped cross-section and along the opposing edges of the vertical strip being provided two elongated flanges respectively, each flange projecting both inward and outward, space regulating pieces engaged in the groove at predetermined intervals and engaged with the bottoms ends of the vertical strips respectively, horizontal clamping bars spaced apart one above the other and having spaced apart threaded holes, cross struts each of which has one threaded end threaded into the holes and other threaded end attached to the opposite form face, each of said cross struts further having a rotary clamp handle sleeved onto and threadedly engaged with the threaded end to be turned manually to push the clamping bar toward the vertical strips and clamp them against the surface of the form, regulating horizontal plates spaced apart one above the other, each of which is placed across two vertical strips and fastened thereto after they are spaced properly.

The present exemplary preferred embodiment will be described in detail with reference to the accompanying drawings.

DETAILED DESCRIPTION OF THE PREFERRED EMBODIMENT

Figure 1:
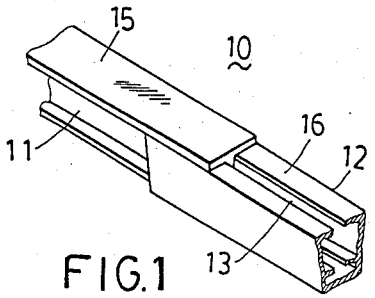
FIG. 1 is a perspective view of a telescopic member.
Figure 2:
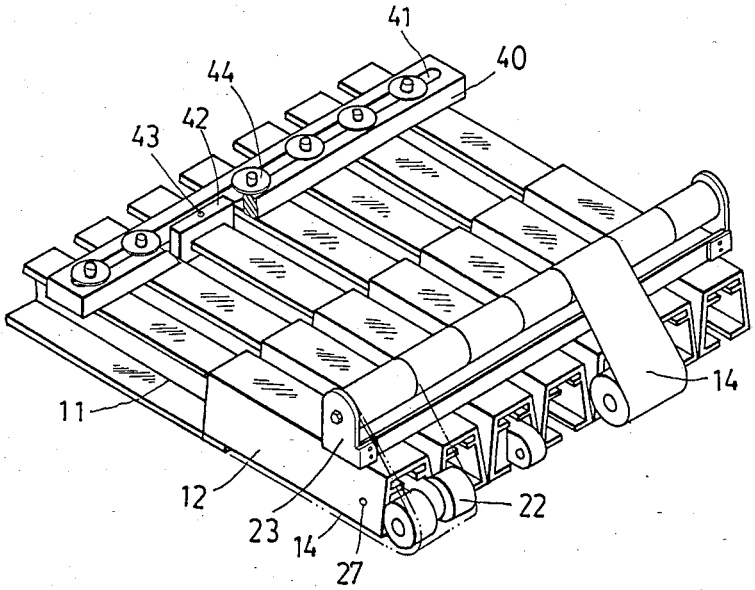
FIG. 2 is a perspective view of a form unit constituted of telescopic member.

In the drawings, the elements which are similar in construction are represented by similar reference numerals. Referring to FIGS. 1 and 2, there are shown a plurality of telescopic members 10 which are juxtaposed and connected to each other to constitute a size variable form unit 1 used for forming a concrete structure. Each telescopic member 10 is comprised of a metal bar 11 of I-shaped cross-section inserted in a metal bar 12. The bar 12 has a cross-section substantially in a shape conforming to a letter E and a reversed E which are interconnected at their bottom sides and are spaced apart at their top sides so that the bar 12 has an aperture 13 extending lengthwise at its top side. The top side of the bar 11 is wider than its bottom side and is exposed on the top side of the metal bar 12 through the aperture 13, thereby causing a difference in the level of the surface of the telescopic member 10. The surface of the telescopic member 10 can be levelled by using a flexible sheet member 14 preferably made of a rubber material which is incorporated into the telescopic member 10 in such a manner that it can be laid flat on the top side 16 of the bar 12 to be flush with the surface 15 of the bar 11.

Figure 3:
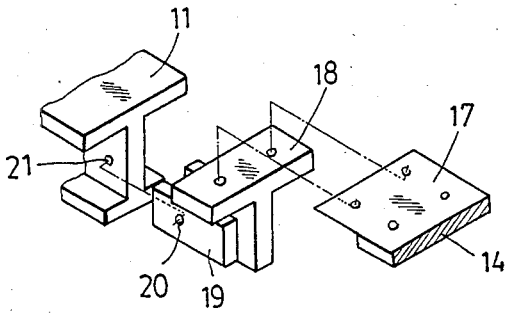
FIG. 3 shows how a flexible sheet member is attached to the bar of I-shaped cross-section.

As shown in FIG. 3, one end of the rubber sheet 14 is secured to a metal plate 17 by means of screws (not shown) and the metal plate 17 is screwed to an attachment piece 18 of a T-shaped cross-section. To the piece 18 is attached a member 19 which is then affixed to the end of the bar 11 which is inserted into the bar 12 by means of a screw (not shown) and screw holes 21 and 20. The rubber sheet 14 is then passed over a pair of plastic rollers 22 and wound on a spool mounted on the reversed side of the bar 12 by means of brackets 23.

Figure 4:
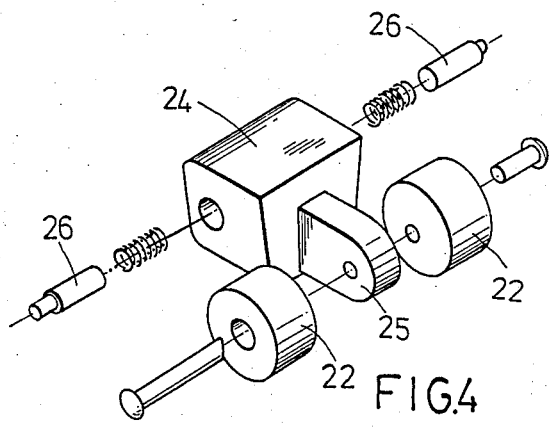
FIG. 4 shows how a roller illustrated in FIG. 2 is mounted on the end of the telescopic member.

Referring to FIGS. 2 and 4, the rollers 22 are attached to one end of each bar 12 by means of an insert body 24 which is inserted into the end of the bar 12 and fixed thereat through the engagement of slots 27 and spring loaded pins 26 provided in the insert body 24. The rollers 22 are mounted on the lobe 25 of the insert body 24.

Figure 5:
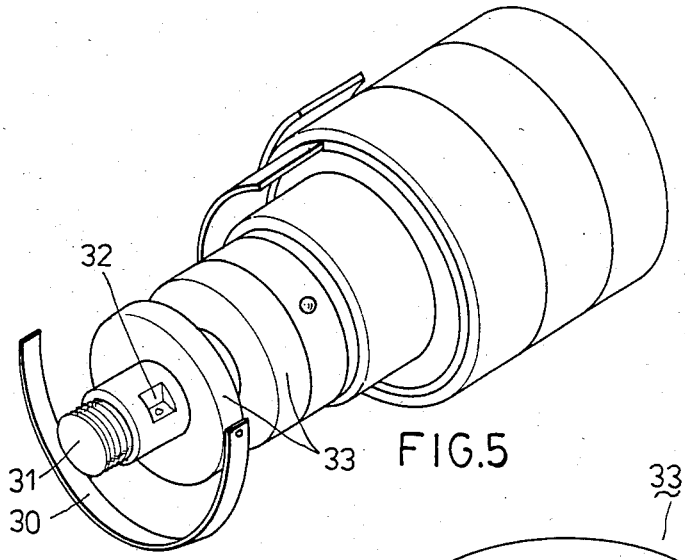
FIG. 5 shows the flexible sheet members wound on the spools.
Figure 6:
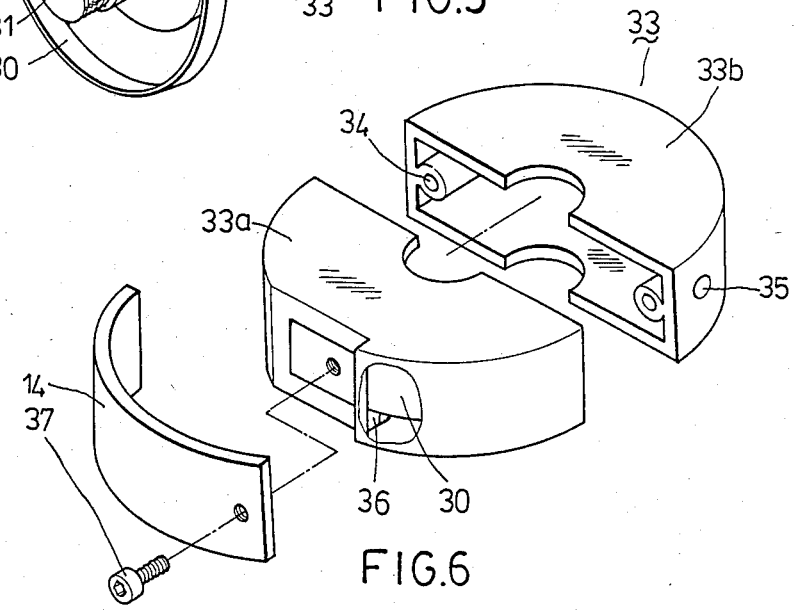
FIG. 6 is a view of a spool with a spring provided therein.
Figure 7:
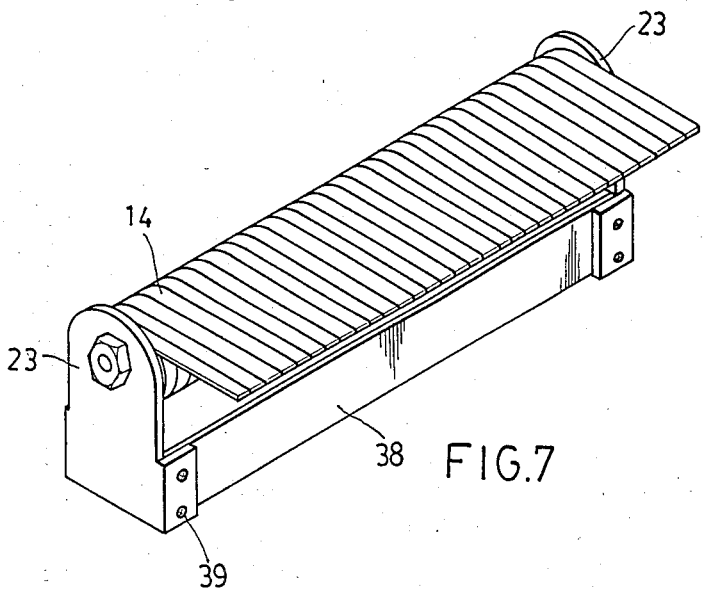
FIG. 7 is a view of flexible sheet members respectively wound on the spools which are supported by an axle mounted on a strap member.

Referring to FIGS. 5, 6 and 7, each rubber sheet member 14 is wound on a spool 33 which is also a housing for a spring 30. The spring 30 biasses the sheet member 14 to cause it to be wound on the spool 33 in its normal position. The spring 30 has its one end secured at 32 to a shaft 31 and wound thereon. The wound spring 30 is encased in spool 13 is constituted of two housing parts 33*a* and 33*b* which are fastened together with screws (not shown) passing through screw holes 34 and 35. The spool 33 has an opening 36 for exposing one end of the spring member 30 to be connected to the end of the rubber sheet 14 with a secrew 37. The spool 33 has a bore 33*c* so that it can be sleeved onto the shaft 31. Two ends of the shaft 31 are mounted on two brackets 23 attached to a strap bar 38 of a U-shaped cross-section, with screws 39, which is welded to the aligned bars 12 so as to tie them together, as better shown in FIG. 2.

Figure 8:
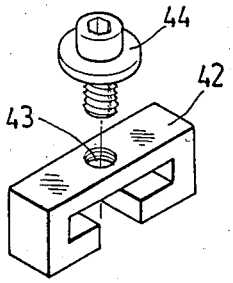
FIG. 8 is a perspective view of a channel piece.

Referring again to FIG. 2 together with FIG. 8, the aligned bars 11 are interconnected by means of a strap 40 provided on the reversed sides of the bars 11. To the bars 11 are attached channel pieces 42 which is shown in FIG. 8 respectively on their reversed sides. The channel pieces 42 are aligned in the elongated slot 41 of the strap 40 and are positioned by tightening screws 44. It can be appreciated that the form unit 1 assembled as described above can be extended to a larger size by drawing the bars 11 outward from the bars 12. When the bars 11 are drawn outward the rubber sheets are unwound from the spools 33 so that the form unit 1 can present an even mold surface.

Figure 9:
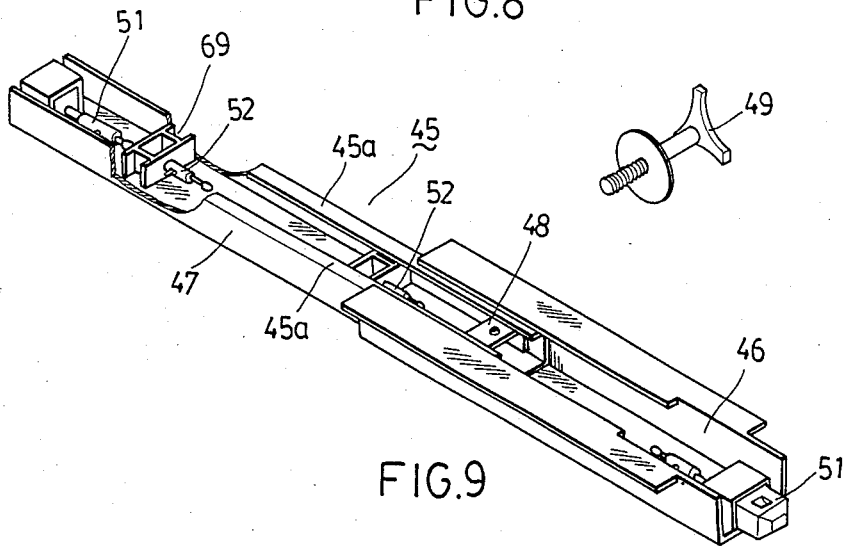
FIG. 9 is a perspective view of a batter.

The apparatus according to the invention further includes telescopic batters, telescopic struts and telescopic diagonal brace members for supporting and reinforcing the form unit 1 when they are erected. As shown in FIG. 9, the telescopic batter 45 is constituted of a channel bar 46 and a channel bar 47 slideably inserted into the bar 46. The channel bar 47 can be locked against movement by means of a U-shaped piece 48 and a locking screw 49 that thrusts the piece 48 to clamp the bar 47 against the bar 46 when the screw is tightened.

Figure 10:
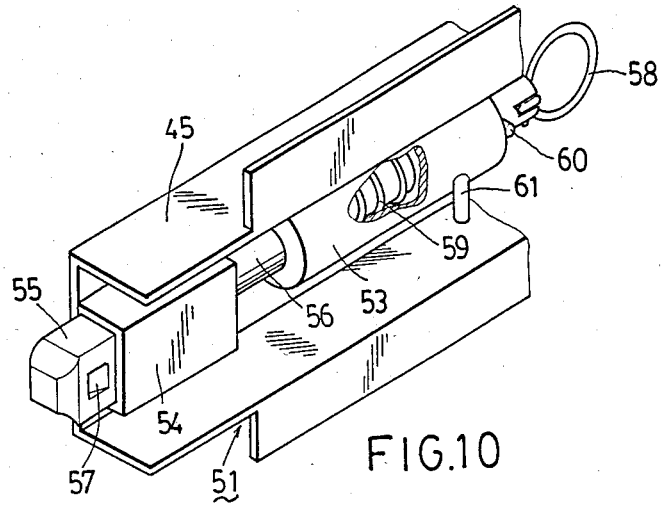
FIG. 10 is a perspective view of a catch member.
Figure 11:
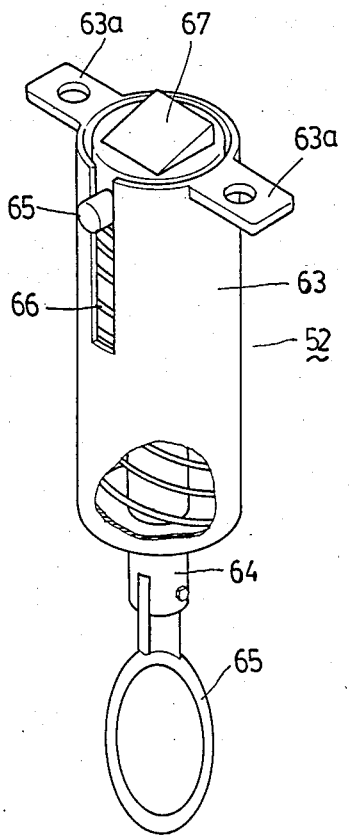
FIG. 11 is a perspective view of a latch member.

To the telescopic batter 45 are attached fastening means 51 and 52 which are used when setting up a mold The fastening means 51 is a catch member, as shown in FIG. 10, which includes a tubular housing 53 and a tongue 55. The tongue 55 has a recess 57 and is provided at one end of a rod 56 which is extended through the tubular housing 53 and then attached with a handle ring 58. A spring 59 is sleeved onto the rod 56 and biasses a cross pin 60 so that the tongue 55 is normally in a retracted position. A tongue housing 54 is further provided for housing the tongue 55. The catch member 51 can be secured to the batter 45 by welding the housings 53 and 54 thereto and restraining it with a member 61. Referring to FIG. 11, the fastening means 52 is a latch member which can be engaged with the catch member 51 to furnish a fastening effect. It includes a tubular housing 63 in which is mounted a rod 64 with its cross pin 65 biassed by a spring 66. At the fore end of the rod 64 is provided a wedge-shaped piece 67 which is normally placed in its extended position and can be engaged in the recess 57 of the catch member 51. At the rear end of the rod 64 is a handle ring 68. Referring again to FIG. 9, the latch member 52 can be secured in the batter 45 by screwing the flanges 63*a* of the housing 63 to a seat 69 which has a slot adaptable to receive the tongue 55 of the catch member 51 and is secured to the batter 45. It can be also movably disposed in the batter 45 being restrained by the flanges 45*a* which prevents its escape.

Figure 12:
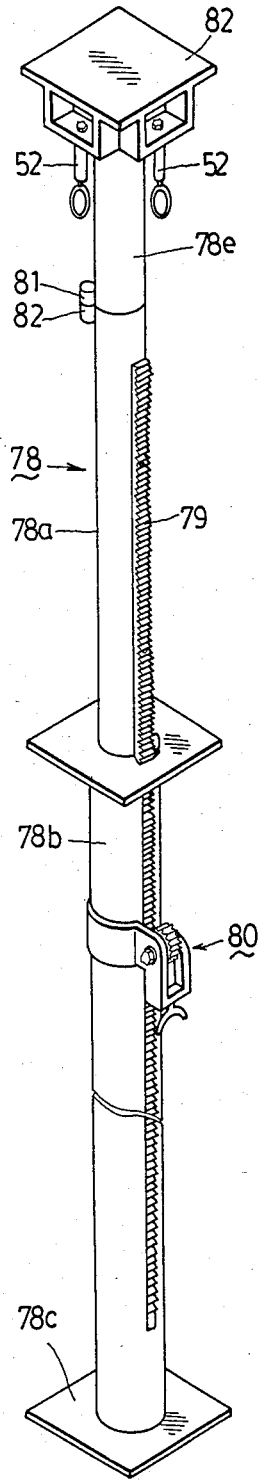
FIG. 12 is a perspective view of a telescopic strut.

Referring to FIG. 12, the telescopic strut 78 is comprised of an upper tubular member 78*a* *slideably inserted in a lower tubular member 78b,* a base 78*c* and a top member 78*e*. To the upper tubular member 78*a* is attached a rack member 79 axially. The attachment of the rack member 79 can be accomplished by providing a groove in the wall of the tubular member 78*a* and securing the rack in the groove with screws. The rack member 79 is extended downwardly beyond the end of the upper member 78*a* to a substantial length and is movably received in a groove provided in the wall of the lower tubular member 78*b*. There is further provided an adjusting unit 80 for adjusting the height of the strut 78.

Figure 13:
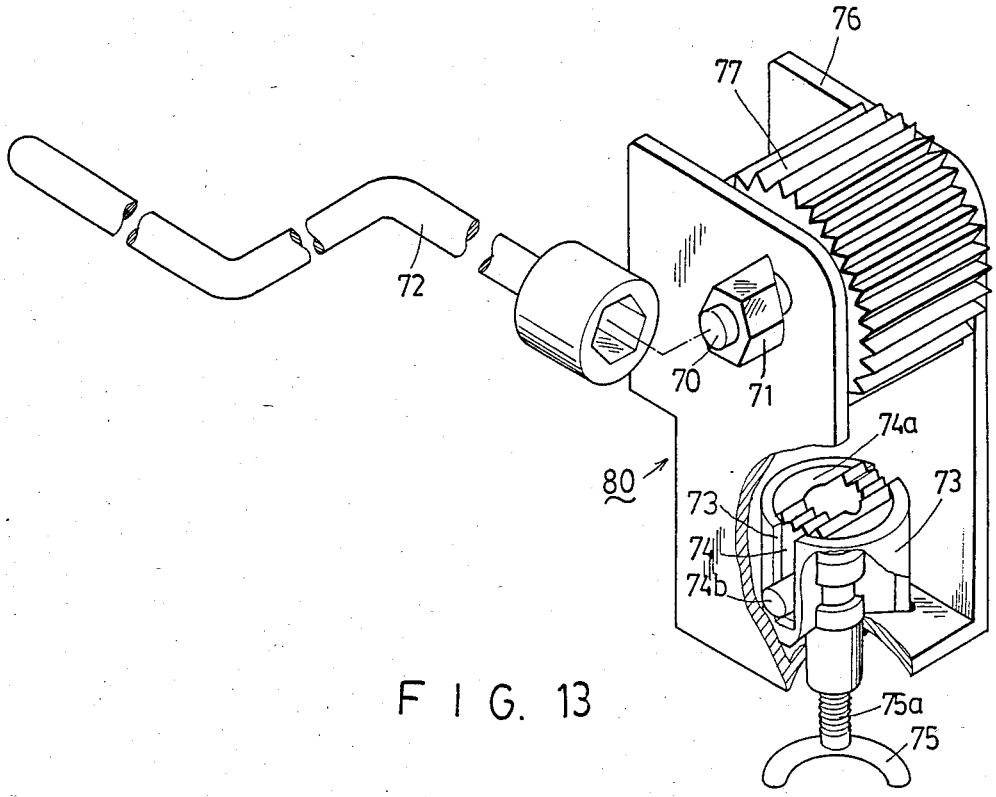
FIG. 13 is a perspective view of a height adjusting unit.

As shown in FIG. 13, the adjusting unit 80 includes a support 76 on which is mounted a gear 77 with a shaft 70. To one end of the shaft 70 is attached a hexagonal piece 71 which can be engaged with a socket of a handle 72 operable by hand for rotating the gear 77. When the gear 77 is rotated, it will move the rack 79 to adjust the height of the strut member 78. In the support 76 is further provided a cylindrical seat 73 in which a cylindrical lock body 74 is movably disposed. The cylindrical lock body 74 has a toothed face 74*a* and a cross pin 74*b* fitted therein. The pin 74*b* is engaged with notches 73*a* for preventing the lock body 74 from rotating. To the lock body 74 is fixed a handle 75 having screw threads 75*a*. By moving the handle 75 the lock body 74 can be engaged with or disengaged from the gear 77. When the strut member 78 is adjusted to a predetermined height, the gear 77 is locked against movement by the lock body 74.

Figure 24:
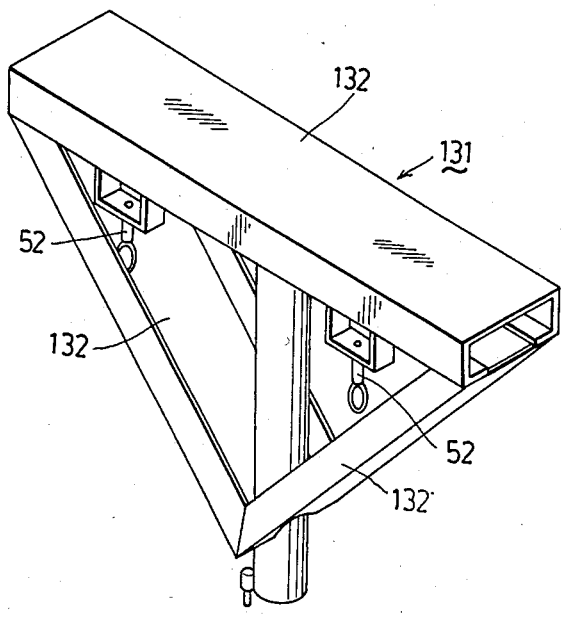
FIG. 24 is a view of a top member of a strut for supporting the joist.
Figure 25:
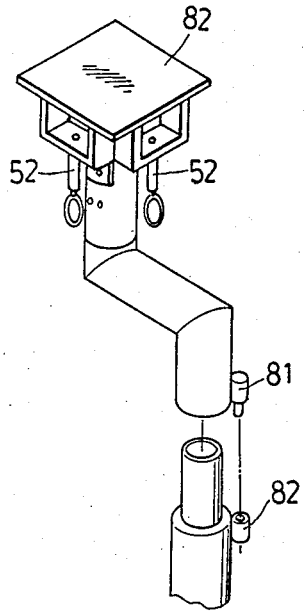
FIG. 25 is a view of a bent top member of a strut.
Figure 35:
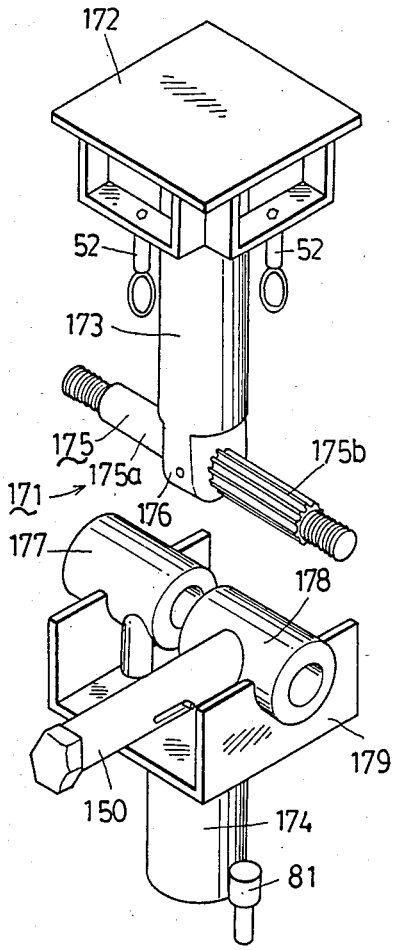
FIG. 35 is a view of a strut having a top member that can be angled.

The top member 78*e* has a bottom tubular neck (not shown) inserted in the top of the tubular member 78*a* and is firmly fastened to the tubular member 78*a* by the engagement of a pintle 81 and a socket 82. The top member of the post 78 may also be in other forms which are shown in FIGS. 24, 25 and 35. At the top of the top member 78*e* is a support plate 82 to which are attached latch members 52 for engaging the catch members 51 which are provided in other units supported by the strut 78.

Figure 14:
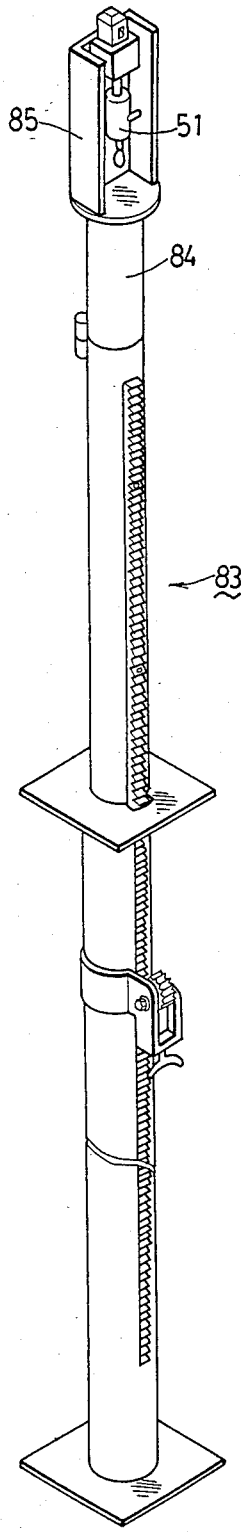
FIG. 14 is a perspective view of a telescopic brace member.

Referring to FIG. 14, the telescopic diagonal brace member 83 is substantially similar in constructin to the strut 78 except that the top member 84 thereof is provided with a catch member 51 and a mounting channel 85.

Figure 16:
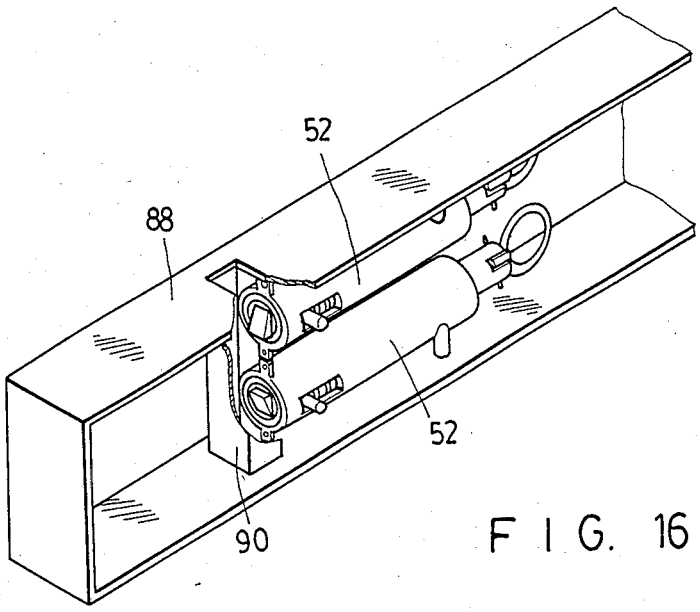
FIG. 16 shows how a catch member or a latch member is attached in a post.
Figure 15:
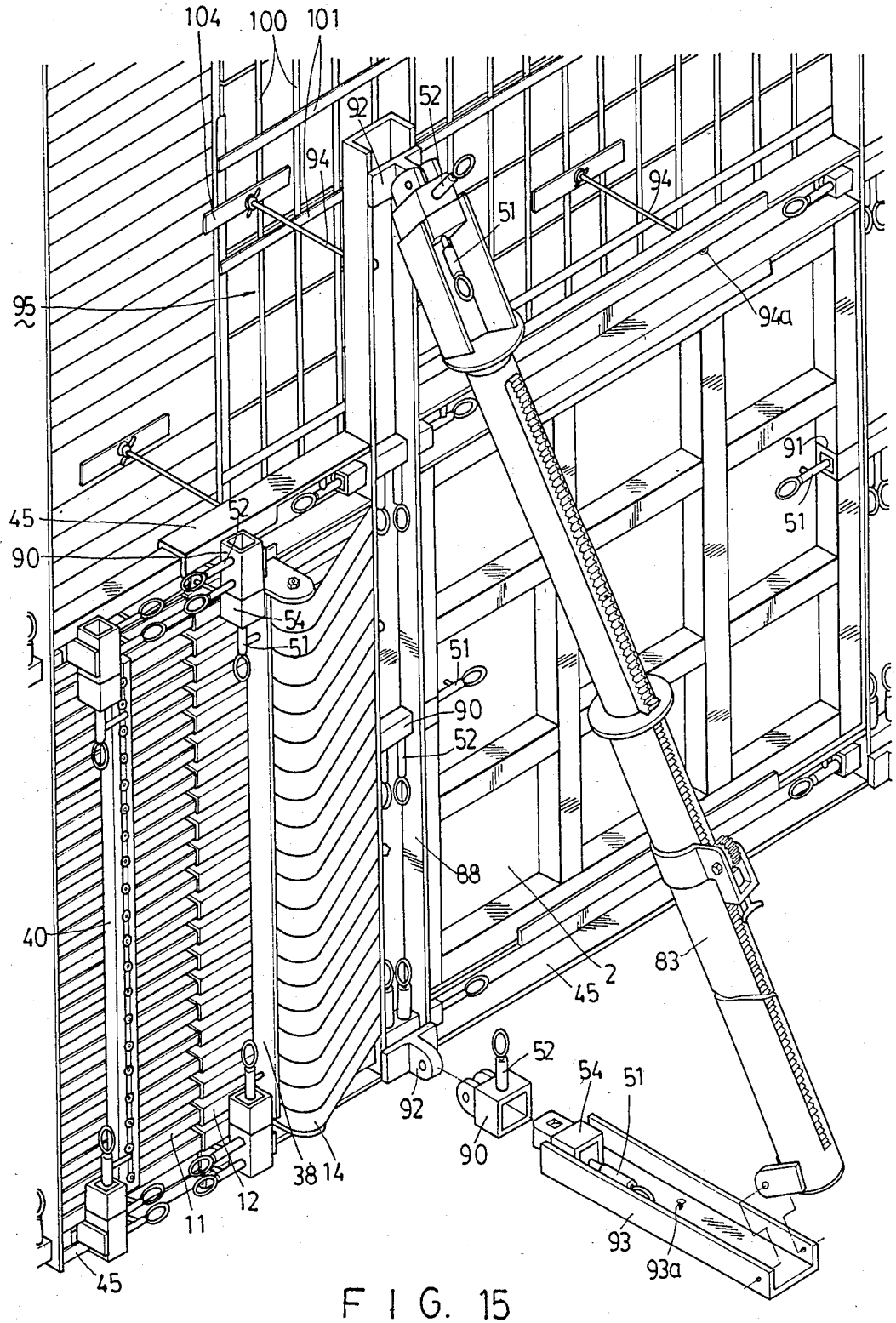
FIG. 15 shows a portion of a form set-up for molding a concrete wall structure.

FIG. 15 shows a portion of a form for molding a concrete wall. The size-variable form unit 1 advantageously used for molding the lateral portions of a wall with dimensions which do not suit the conventional mold panels. The form unit 1 constituted of telescopic members 10 are connected to a lower and an upper batters 45 and two posts 88. The form unit 1 has its four sides juxtaposed to the sides of the batters 45 and posts 88 and is fastened to them with catch members 51 and latch members 52. Catch members 51 and latch members 52 are secured to the batters 45 and posts 88 such as by welding or screwing. In attaching the latch member 52 to the post 88, it is secured to a seat 90 which in turn is fixedly attached to the post 88, as better shown in FIG. 16. The catch members 51 and latch members 52 are located at proper locations so that they can be engaged with one another. For example, a catch member 51 attached to the upper side of the strap 38 of the form unit 1 is engaged with the latch member 52 provided in the upper batter 45 at a location that meet the catch member 51. The tongue 55 of the catch member 51 is pushed into the seat 90 and engaged with the wedge-shaped piece 67. They can be disengaged from one another by pulling the handle ring of the latch member 52.

The catch member 51 and the latch member 52 can also be attached to the mold slab 2 of a fixed dimension by positioning them in the recesses 91 provided in the slab 2. The post 88 is set in an upright position with a brace 83. At the top and the bottom of the post 88 are welded T-shaped pieces 92 to which are screwed seats 90 with latch members 52. The latch member 52 is then engaged with a catch member 51 mounted in a channel member 93, the end of which is screwed to the bottom end of the brace 78 and is fixed temporarily with a screw 93*a* to the floor. The top end of the brace 78 is also fastened to the top end of the post 88 by a catch member 51 and a latch member 52. When the adjusting unit 80 is operated by hand, the height of the brace member 78 is adjusted to place the post 88 in an upright position.

Figure 17:
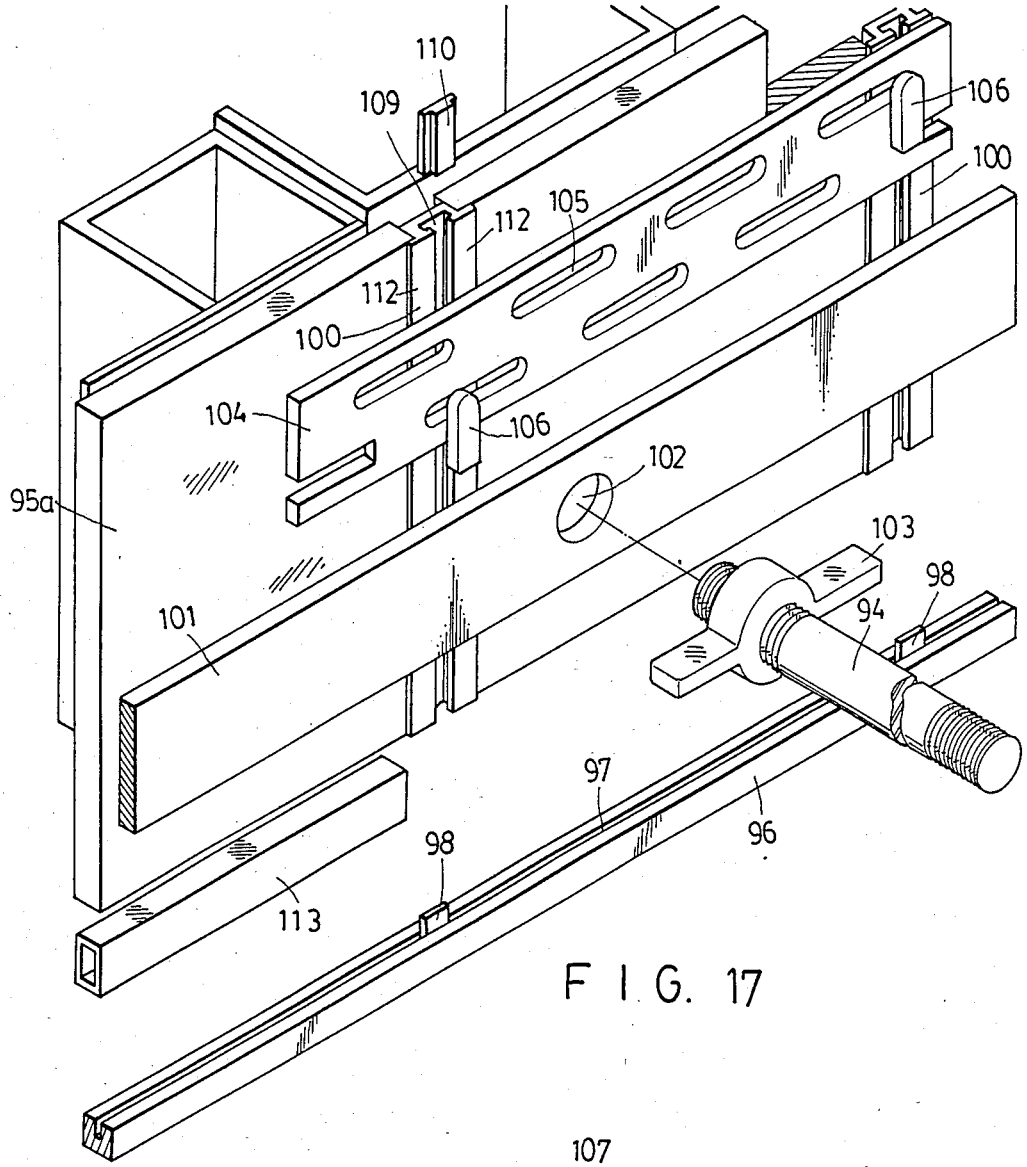
FIG. 17 is a view of a portion of a framework for arranging tiles.

There are further provided cross struts 94 which have threaded ends 94*a* inserted in threaded slots provided in opposite batters 45 and opposite post 88. Adjacent to the mold surface of the form set-up is provided a framework 95 for arranging tiles 95*a* so that the tiles can be bonded to the concrete wall during forming. As shown in FIG. 17, the framework 95 is constituted of a horizontal base strip 96 having a groove 97 extending lengthwise and fixed on the floor adjacent to the form face. In the groove 97 are provided space regulating pieces 98 at predetermined intervals similar to the width of a tile. Vertical strips 100 are set upright on the base strip 96, engaging the pieces 98 with their bottom ends. Each vertical strip 100 has a U-shaped cross-section and along the opposing top edges thereof are provided two flanges 112 respectively each of which is projected both inward and outward. These vertical strips 100 are held against the mold surface by using spaced apart horizontal clamping bars 101 each of which is provided with spaced apart threaded holes 102. The threaded ends of the cross struts 94 are inserted into the holes 102 and the bars 101 are pushed toward the vertical strips 100 by manually turning rotary clamp handles 103 threadedly sleeved on the ends of the cross struts 94, thereby clamping the vertical strips 100 against the mold face.

In order to regulate the space between two strips 100, there are further provided horizontal space regulating plates 104 each of which has oblong apertures 105. Each horizontal plate 104 is provided across two vertical strips 100 and the strips 100 are fastened to the plate 104 with keys 106 after they are spaced properly so that a tile can be located therebetween.

Figure 18:
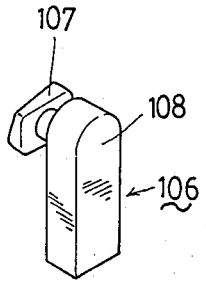
FIG. 18 is a view of a key illustrated in FIG. 17.

Referring to FIG. 18, the key 106 has a wedge-shaped engaging portion 107 and a knob 108. To fasten the strip 100 to the plate 104, the wedge-shaped portion 107 is passed through the slot 105 and then inserted into the groove 109 of the vertical strip 100 by turning the key 106 to 90 degrees. After the portion 107 is inserted into the groove 109, the key is turned again so that the wedge-shaped portion 107 is engaged in the groove 109. A vertical strip 100 can be connected to another vertical strip 100 by means of a joint 110 which has a T-shaped cross-section. In arranging the tiles, tiles are put in between two strips 100 by slightly pulling the strips 100 apart from the surface of the form and then they are clamped by the flanges 112 of the vertical strips 100 against the face of the form. Between the tiles are further provided spacers 113.

Figure 19:
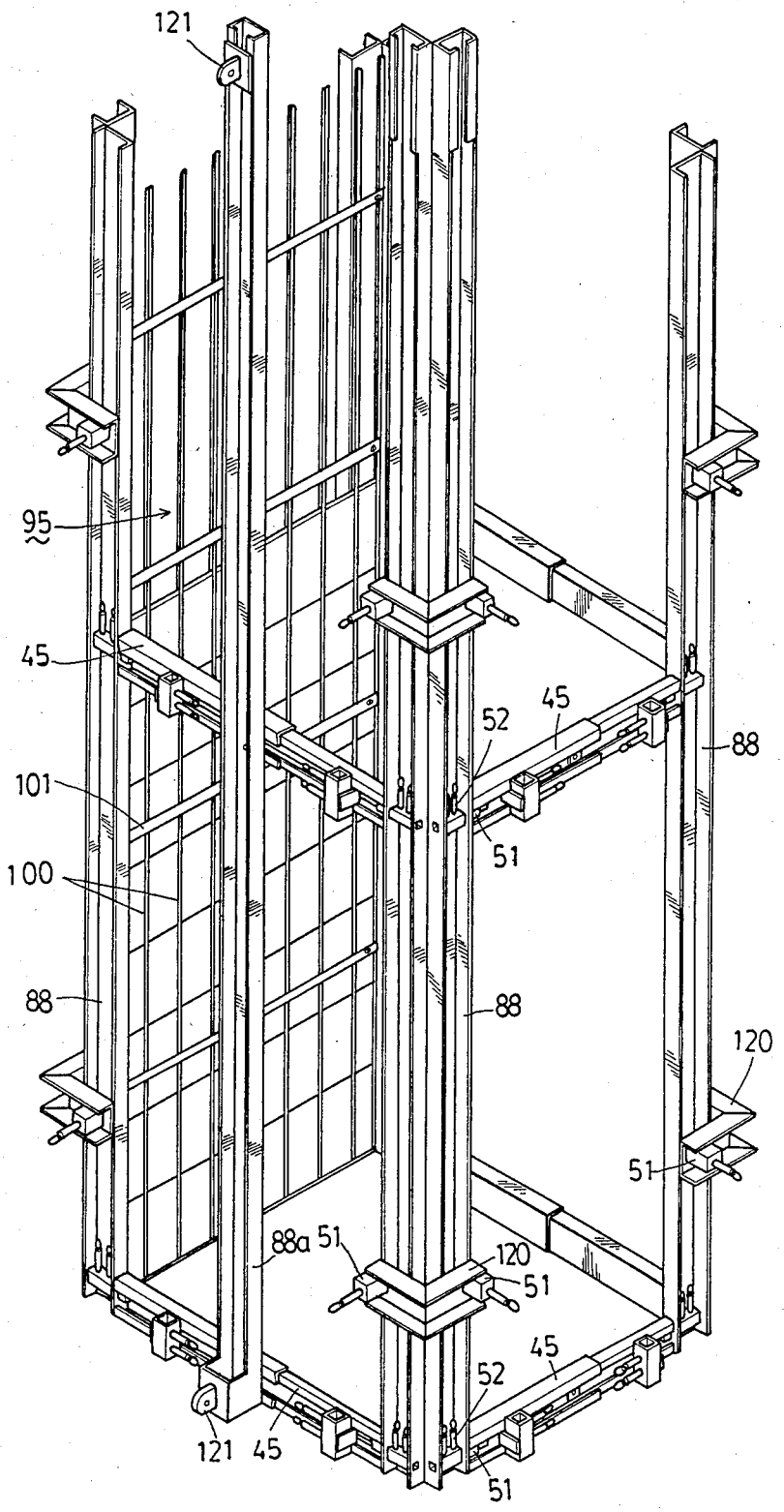
FIG. 19 is a view of a portion of a form set-up for molding a concrete column.

FIG. 19 shows how posts 88 and batters 45 are set up for molding a concrete column using catch members 51 and latch members 52. A framework 95 for arranging tiles including vertical strips 100 and horizontal clamping bars 101 is also incorporated into this form set-up. The angled pieces 120 are used for mounting the catch members 51 and latch members 52 on two adjacent posts 88 placed at the corners. The post 88*s* which is placed between two corner posts 88 is provided with brackets 121 for attachment of a catch member 51 or latch member 52 so that the post 88 can be connected to a diagonal brace member (not shown) that will support it in an upright position.

Figure 20:
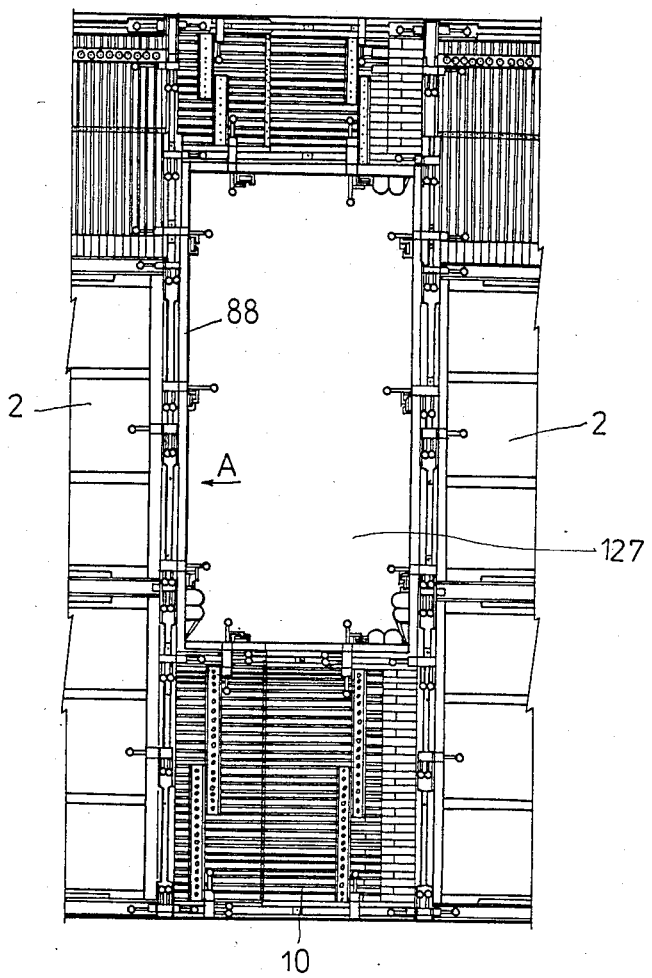
FIG. 20 is a view of a portion of a form set-up for molding a wall having an opening.
Figure 21:
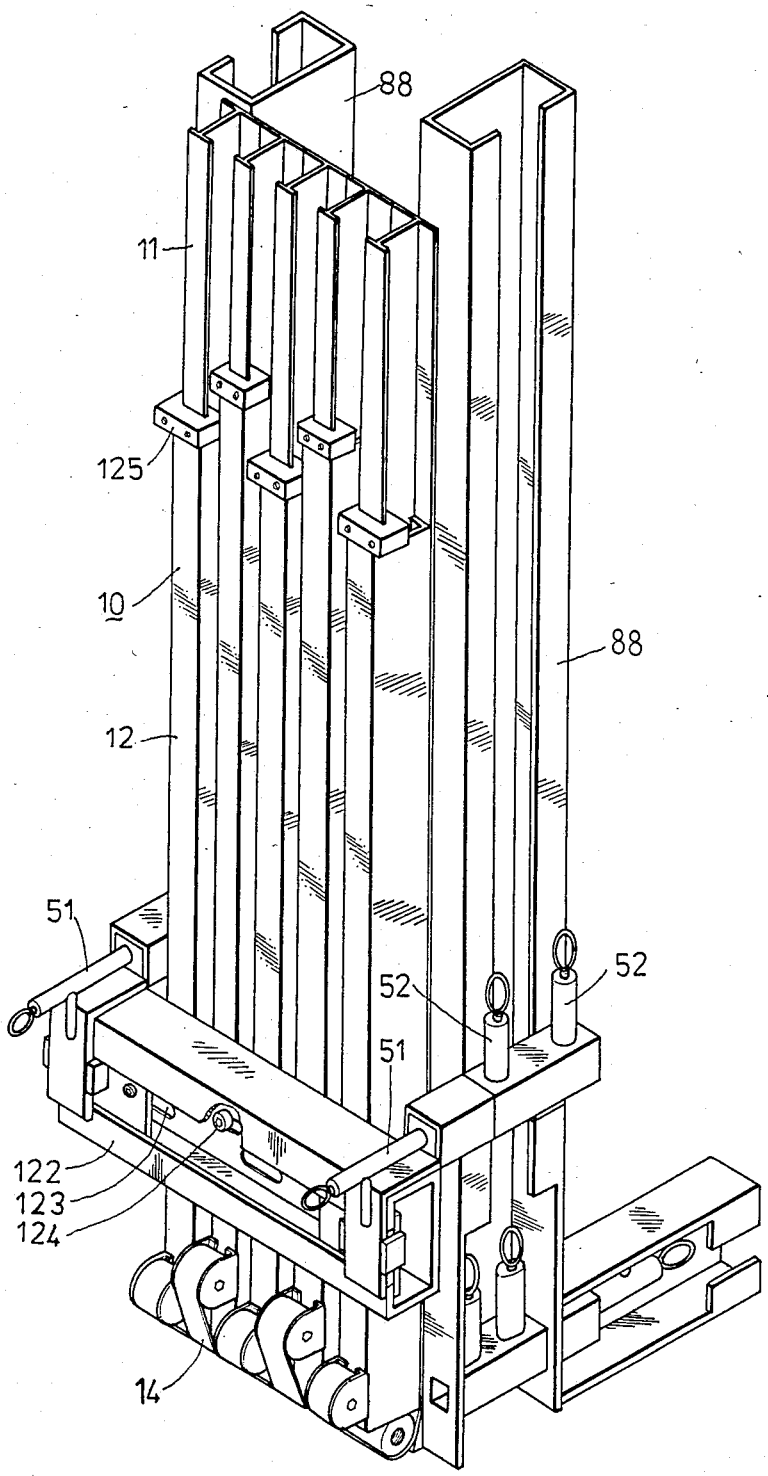
FIG. 21 is a perspective view of a portion of the form set-up illustrated in FIG. 19 that is viewed from another position.

Referring to FIGS. 20 and 21, there is shown a portion of form set-up for forming a wall with an opening. Telescopic members 10 are assembled together to form segments of the form that defines the opening 127. The telescopic members 10 in FIG. 20 form a part of form that is viewed along the arrow A. They are interconnected by steel channels 122 instead of using straps 38 and 40 which are shown in FIG. 2. The spools of the belt 14 are not mounted on the strap 38, but are mounted on the respective telescopic members 10. The steel channel 122 is provided with oblong shaped apertures 123 and the bars 12 of the telescopic members 10 are fastened to the steel channel 122 by means of screws 124 which pass through the apertures 123. To the bars 11 of the telescopic members 10 are attached channel pieces 125 each of which has two screw holes, one for attaching a screw that fixes the piece 125 to the bars 11 and the other for securing the bars 11 to another steel channel 122 which will be disposed across the bars 11.

Figure 22:
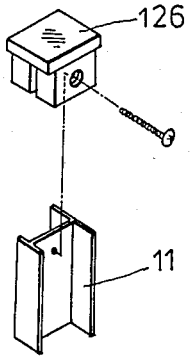
FIG. 22 is a view of a cap of the telescopic member.

After assembly, the telescopic members 10 are fastened to two opposite posts 88 with catch members 51 and latch members 52. The top of the bars 11 are provided with caps 126 as shown in FIG. 22.

Figure 23:
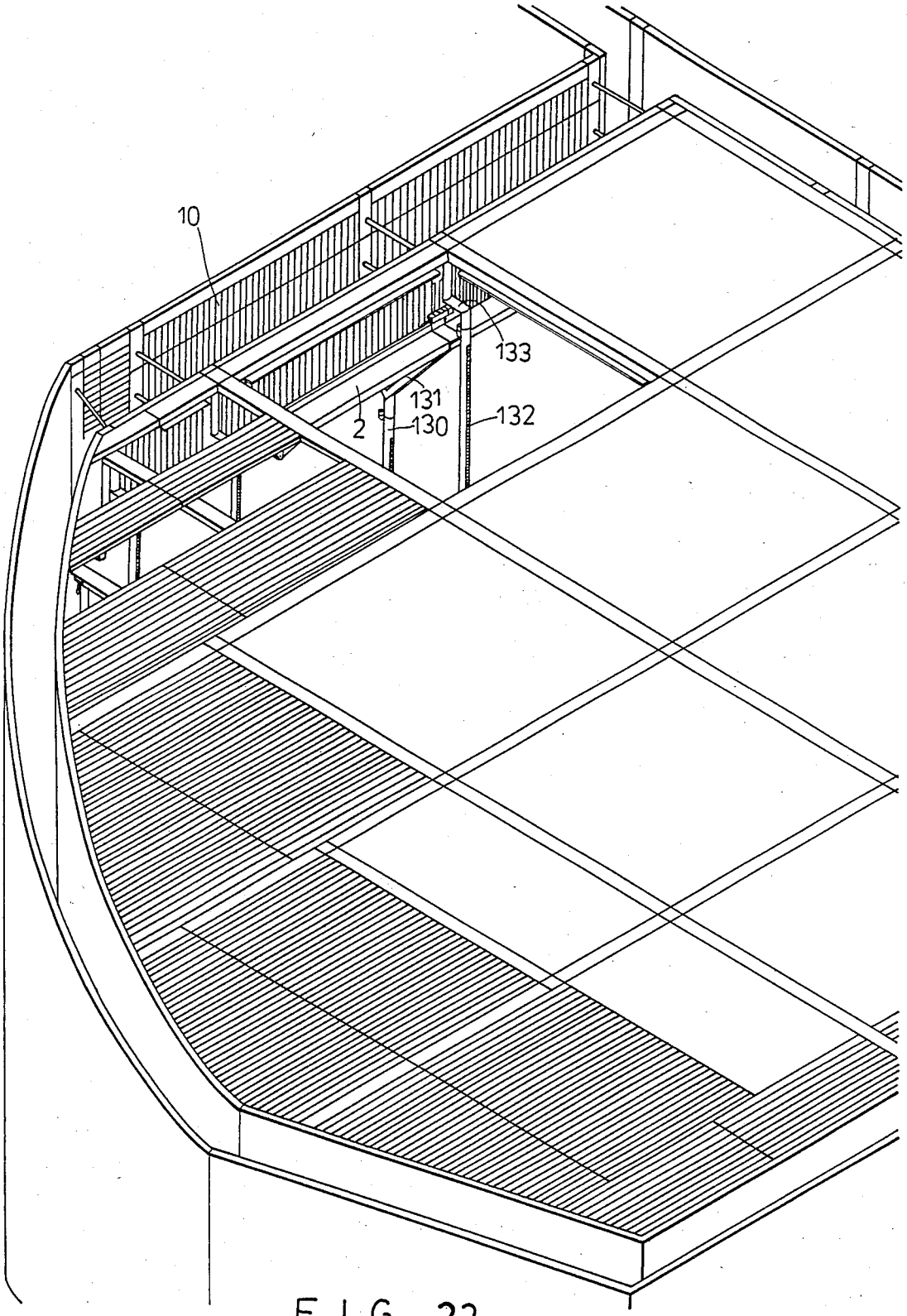
FIG. 23 is a view of a portion of a form set-up for molding a floor.

Referring to FIG. 23, there is shown a portion of a form set-up for molding a ceiling and a joist. The strut 130 for supporting the form for molding the joist is substantially similar in construction to the strut 78 except that it is provided with a top member 131 which includes three steel channels 132 interconnected to form a triangular shape, as better shown in FIG. 24. Two latch members 52 are attached to the horizontal steel channel 132 for engaging with catch members 5 which are provided in adjacent batters 45 (not shown). The portion of the form for forming the joist is constituted of telescopic members 10 for vertical sides and slabs 2 for the horizontal side which are supported by the strut 130. The strut 132 has a construction similar to the strut 78 except that its top member 133 is bent, as better shown in FIG. 25.

Figure 26:
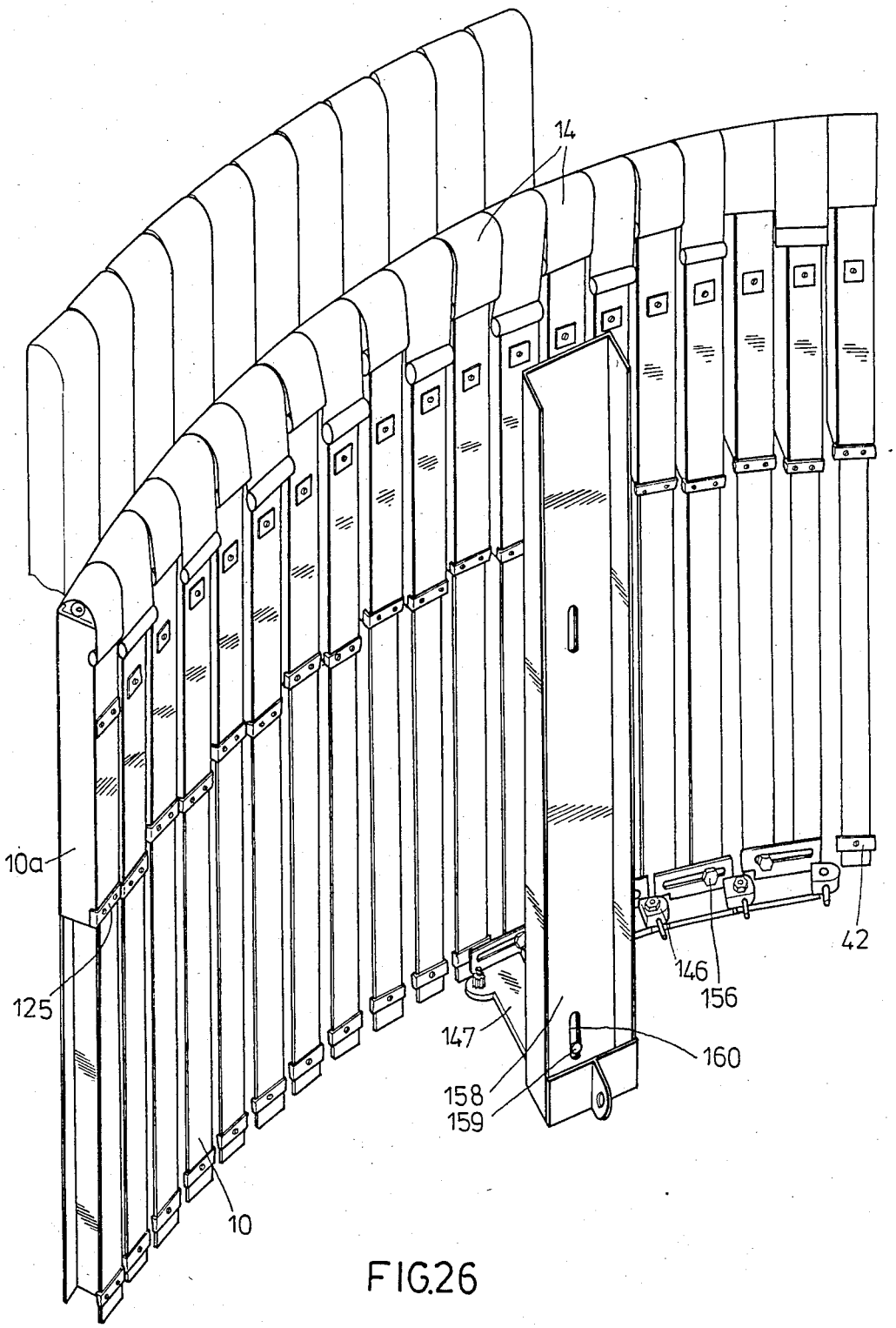
FIG. 26 is a view of a portion of a form set-up for molding a curved concrete wall.
Figure 27:
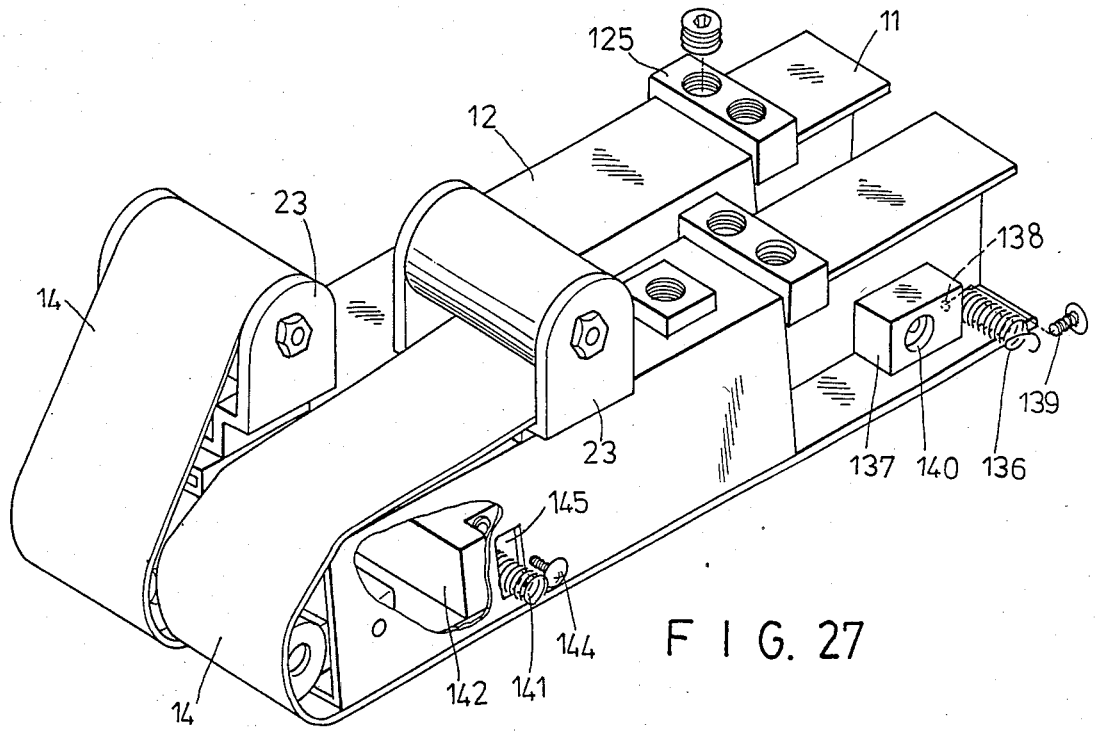
FIG. 27 is a view of two telescopic members shown in FIG. 25 which are connected by helical springs.

Referring to FIG. 26, there is shown a portion of the form set-up for forming a curved concrete wall. In assembling a curved form wall, telescopic members 10 are interconnected by springs 136 and 141, as shown in FIG. 27 which are disposed on two sides of the bars 11 and 12 of the telescopic members 10. One end of each spring 136 is secured in the hole 138 of a seat 137 with a screw 139. The seat 137 is secured to one side of the bar 11 with a screw (not shown) passing through the hole 140 and penetrating into another seat 137 on other side of the bar 11. The other end of the spring 136 is then secured in the seat 137 of the adjacent bar 11, thus connecting the two adjacent bars 11.

Figure 28:
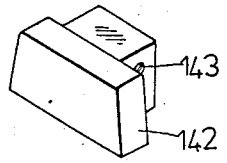
FIG. 28 is a view of a T-shaped piece.

One end of each spring 141 is secured in the hole 143 of a T-shaped piece 142 provided in the bar 12 of a telescopic member 10. As shown in FIG. 28, each T-shaped piece 142 has two screw holes 143 for attachment of two springs 141 on two sides of the bar 12 with screws 144. The bar 12 has two openings 145 for exposing the springs 141.

The spools of the belts 14 mounted on the bars 12 are staggered with each other so that the brackets 23 of the adjacent bars 12 will not engage each other when the telescopic members 10 are arranged in a curved shape. The belts 14 which are adjacent each other are wound on the spools in different directions so that they will not touch or engage with each other when the telescopic members 10 are arranged in a curved shape.

Figure 29:
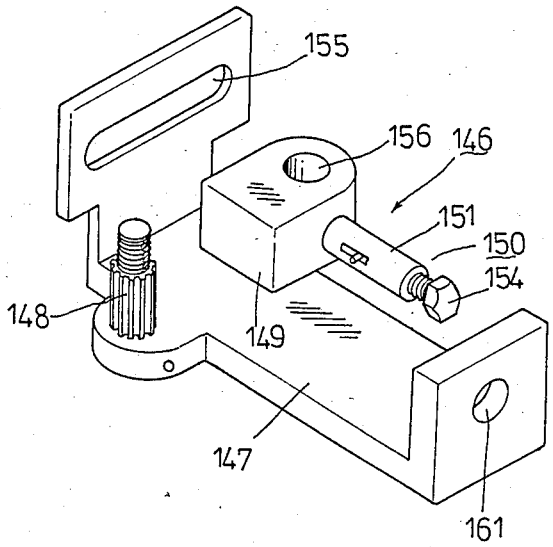
FIG. 29 shows a locking member illustrated in FIG. 26.
Figure 30:
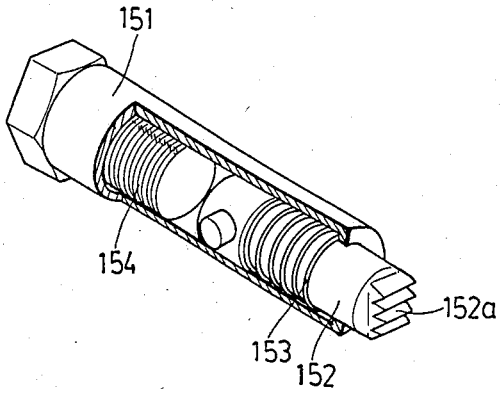
FIG. 30 is a view of an engaging member.

Referring to FIGS. 26, 29 and 30, the telescopic members 10, after being arranged in a curved shape, are held in place by locking members 146. The locking member 146 includes a support 147 substantially in a U-shaped cross-section on which are mounted a gear 148 and a seat 149. To the seat 149 is welded an engaging member 150 which includes a tubular housing 151 receiving a rod 152 having a toothed face **152*a* and loaded with a spring 153 and a threaded member 154. The support 147 is provided with an oblong shaped aperture 155 and thus it can be attached to a telescopic member 10 by means of a screw 156 which passes through the aperture 155 and penetrates into the channel piece 42**.

The seats 149 are further provided with slots 156 for receiving the gears 148. In connecting, the locking members 146, the seat 149 of one locking member 146 is sleeved onto the gears of the adjacent locking member 146. After the telescopic members 10 are placed in proper positions, the toothed faces **152*a* of the engaging members 150 are caused to engage with the gears 148 respectively by turning the threaded members 154. The gear members 148** are further provided with nuts (not shown) at their threaded top portion.

Figure 32:
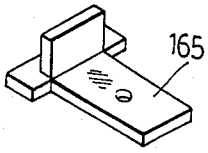
FIG. 32 is a view of a securing piece for positioning the base strip illustrated in FIG. 17.
Figure 33:
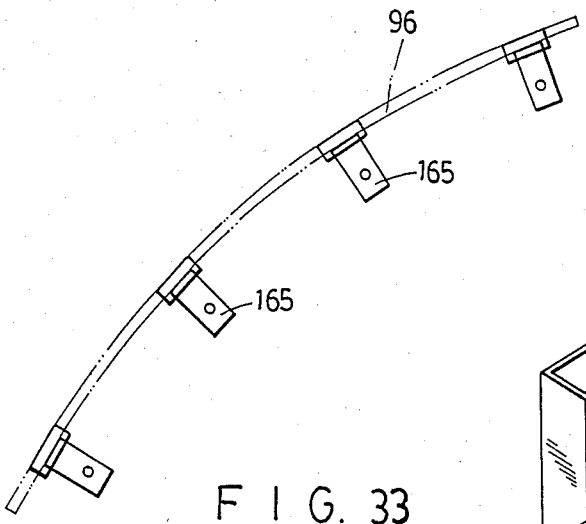
FIG. 33 shows how a base strip is positioned by the securing pieces illustrated in FIG. 31.
Figure 31:
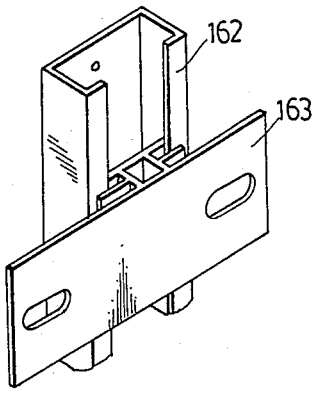
FIG. 31 is a view of a portion of a post.

The support 147 can be further attached to a steel channel 158 with a screw 159 inserted into the hole 160 of the channel 158 and the hole 161 of the support 147. The steel channel 158 can be connected to a diagonal brace member (not shown). The telescopic member at the end of the form which is specifically represented by **10*a* can be connected to a post 162 which is shown in FIG. 31 with a member 163 and screws (not shown). A framework for arranging tiles can also be incorporated into this curved form. In setting up the framework the base strip 96 which is shown in FIG. 17 must be curved and positioned on the floor by using lock pieces 165, as shown in FIGS. 32 and 33, which clamp the strip 94** against the form face.

Figure 34:
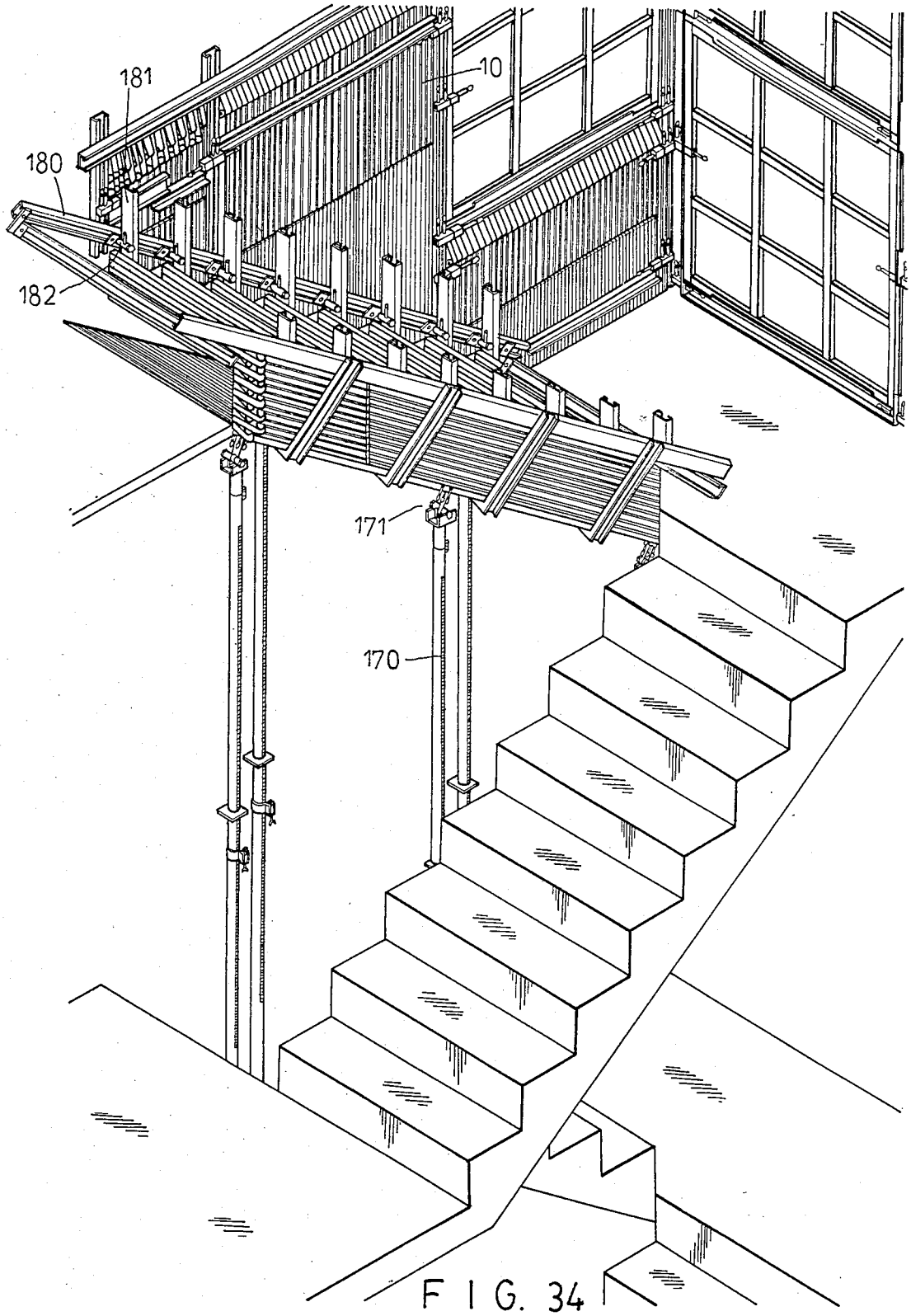
FIG. 34 is a view of a portion of a form for molding a staircase.

Referring to FIG. 34 the strut 170 for supporting an inclined form unit is provided with a top member 171 which can be adjusted to a desired inclined position. As shown in FIG. 35, the top member 171 includes a support top plate 172 mounted on a cylindrical upper member 173 which is pivoted to a lower tubular member 174 which in turn is connected to the telescopic portion of the strut illustrated in FIG. 12. The upper member 173 is pivoted by means of a pin 175 passing through and screwed to the lobe 176. The pin 175 has a portion **175*a* and a toothed portion 175*b* on which are sleeved two sleeves 177 and 178 respectively. The sleeves 177 and 178 are then welded on a seat 179. To the sleeve 178 is attached an engaging member 150 which is illustrated in FIG. 30. After the upper member 173 is turned to a predetermined angle, the engaging member 150 is caused to be engaged with the toothed portion 175*b***.

Figure 36:
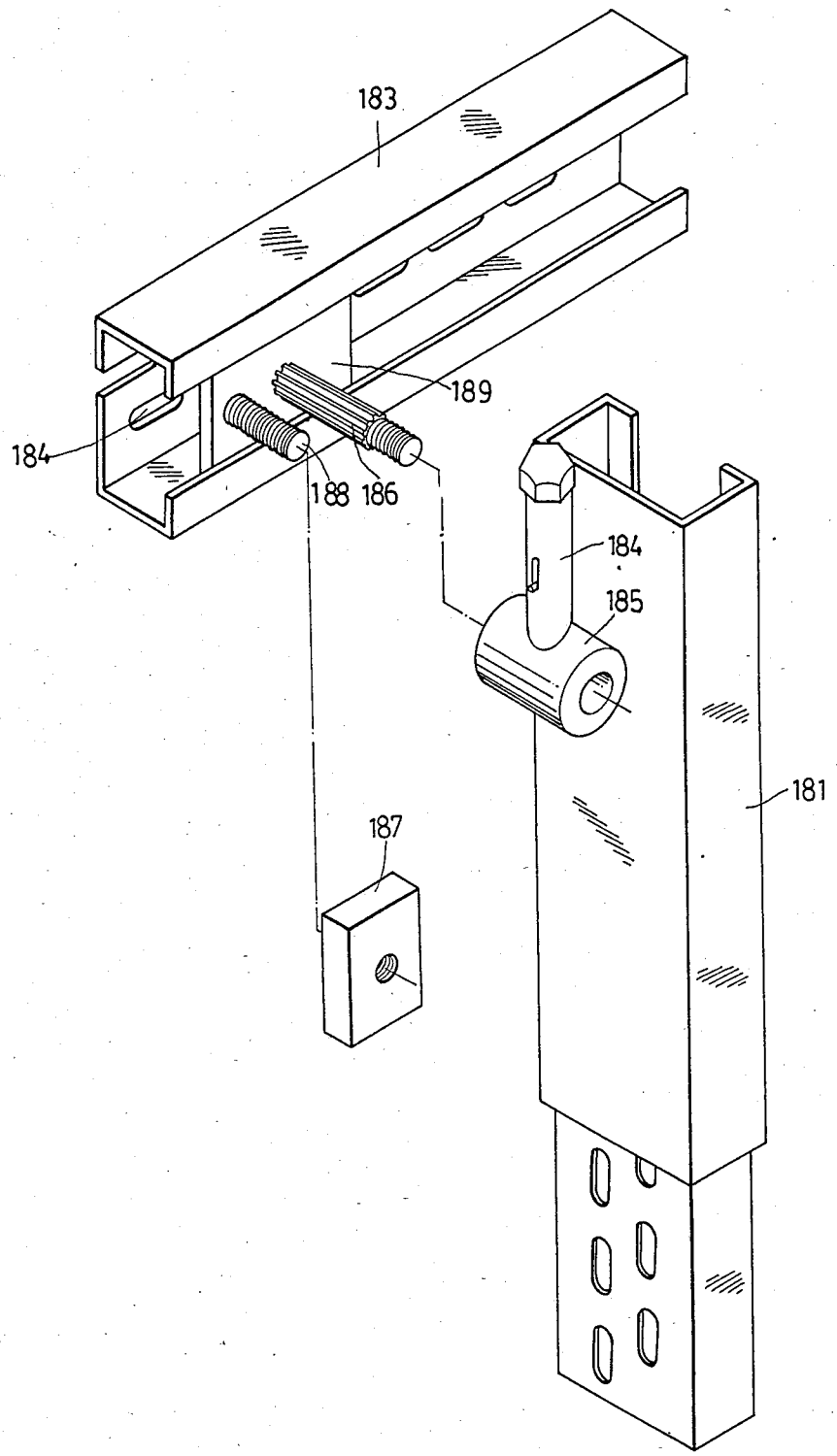
FIG. 36 is a view showing how an inclined member is fastened to a post.

The inclined support bar 180 and the posts 181 are fastened by a fastening means 182 which permits the inclined support bar 180 to be set in any inclined position relative to the posts 181. As shown in FIG. 36, the channel pieces 183 having apertures 184 are movably provided inside the support channel bar 180 in a manner such that they are located adjacent to the posts 181 respectively. Each post 181 is provided with an engaging member 184 similar in construction to the engaging member 150 shown in FIG. 30 and attached to a sleeve 185. In connecting the bar 180 to the posts 181, the sleeve 185 is sleeved onto the toothed member 186 of a seat 189 provided in a channel piece 183 which is provided in the bar 180 before the supports bar 180 are inclined to a desired inclination relative to the posts 181. After the bars 180 are inclined to a desired inclination, the toothed members 186 of the channel pieces 183 are engaged with the toothed faces of the engaging members 184 respectively. The nut 187 is then sleeved onto the screw 188 of each channel 183 to fix the channel piece 183 to the support bar 180.

With the invention thus explained, it is apparent that various variations and modifications can be made without departing from the scope of the invention. It is therefore intended that the invention be limited as indicated in the appended claims.

What I claim is:

1. An apparatus used for forming a concrete structure comprising: a plurality of telescopic members having a surface against which concrete is formed, said members, to be assembled into a size variable form unit, each of said members including a first member, a second member slideably inserted into said first member, means for connecting said telescopic members side by side, and means for levelling said concrete forming surface of said telescopic member including a spool on which is wound a flexible sheet member attached to said first member, one end of said sheet member being affixed to one end of said second member, said sheet member being unwound and laid flat on one surface of said first member when said second member is drawn outward so that the surface of said first member is flush with the surface of said second member.

2. An apparatus as claimed in claim 1, wherein said second member is a bar having an I-shaped cross section and said first member has a cross-section substantially in a shape conforming to an alphabetical letter E and a reversed E which are interconnected at their bottom sides and are spaced apart at their top sides so that said first member has an aperture extending lengthwise at its top side, the top side of said second member being exposed through said aperture and the remaining portion of said second member being inserted in said first member.

3. An apparatus as claimed in claim 1, wherein said one end of said sheet member is secured to a plate which is secured to the top side of an attachment piece of a T-shaped cross-section, said attachment piece having its lower side slideably inserted in said first member and attached to said second member, the top side of said piece being exposed on the top of said first member member.

4. An apparatus as claimed in claim 2, wherein said sheet member is passed over a roller provided at the end of said first member and said spool is mounted on the reversed side of said first member.

5. An apparatus as claimed in claim 1, wherein said spool is provided with a spring thereinside connected to the other end of said flexible sheet member so that said flexible sheet member is normally biassed to be wound on said spool.

6. An apparatus as claimed in claim 1, in which said telescopic members are assembled into a size variable flat form unit, wherein said connecting means includes strap bars placed across and fastened to said telescopic members.

7. An apparatua as claimed in claim 6, wherein said strap bars include a first strap bar placed across said first members and a second strap bar placed across said second members, and said spools of said telescopic members are mounted on an axle which is mounted on said first strap bar.

8. An apparatus as claimed in claim 1, in which said telescopic members are formed into a size variable curved form unit, wherein said connecting means includes, helical spring members interconnecting said telescopic members, and means for locking said telescopic members against movement after they are arranged to have a predetermined curvature.

9. An apparatus as claimed in claim 8, wherein said locking means includes a support on which are mounted a first gear member and a first engaging member having a first toothed face to be engaged with said gear member, means for holding said first engaging member in an engaged position, said supports being fixed to said telescopic members respectively and interconnected in a manner such that adjacent supports overlap each other and said gear member of one said support is engaged with said engaging member of the other said support.

10. An apparatus as claimed in claim 9, wherein said first engaging member is a first spring loaded rod which has its fore end face formed into said first toothed face and is normally biassed backward, and wherein said holding means includes a first tubular housing receiving said first spring loaded rod and a threaded member threadedly inserted into the rear side of said tubular housing for pushing forward said first spring loaded rod.

11. An apparatus as claimed in claim 10, wherein said spools are mounted on different axles horizontally from one another and which are mounted on said first members respectively.

12. An apparatus as claimed in claim 1, further comprising telescopic batters for supporting said telescopic members, each of said batters having two channel bars one inserted in the other and means for fixing one bar to another when said batter is adjusted to a predetermined length.

13. An apparatus as claimed in claim 1, further comprising telescopic strut members for supporting said telescopic members, each of said strut members including an upper and a lower elongated tubular member, one inserted in the other, a top member connected to the top side of said upper tubular member and having a support plate, and a height adjusting means for said strut member.

14. An apparatus as claimed in claim 13, wherein said height adjusting means includes an elongated rack member fixed longitudinally to said upper tubular member, a second gear member fixedly mounted on said lower tubular member and meshed with said rack member, a second engaging member having a second toothed face for engaging with said gear member, whereby said strut can be extended by manually turning said second gear member to move said rack member upward and said upper tubular member can be locked to prevent movement by the engagement of said toothed face and said second gear member.

15. An apparatus as claimed in claim 14, further comprising means for fastening said telescopic member to said batter, said means including a spring catch member and a spring latch member which can be engaged or disengaged from one another by pushing or pulling respectively.

16. An apparatus as claimed in claim 15, wherein said catch member includes a second tubular housing receiving a second spring loaded rod, the fore end of said rod having a tongue which has a recess therein and is normally biassed backward, and said latch member includes a third tubular housing receiving a third spring loaded rod, the fore end of said third rod having a wedge-shaped portion to be engaged with said recess and being normally biassed forward.

17. An apparatus as claimed in claim 16, further comprising a framework for arranging tiles over the surface of the form, said framework constituted of a horizontal base strip having a first U-shaped groove extending lengthwise and fixed on the floor adjacent to the form face, a plurality of vertical strips set upright on said base strip, said vertical strip having a U-shaped cross-section while along the opposing top edges of said vertical strip are provided two elongated flanges respectively, each of said flanges projecting both inward and outward, first space regulating pieces engaged in said groove at predetermined intervals and engaged with the bottom ends of said vertical strips respectively, horizontal clamping bars spaced apart one above the other and having spaced apart threaded holes, cross struts each of which has one threaded end threaded into said holes and other threaded end attached to the opposite form face, each of said cross struts further having a rotary clamp handle threadedly sleeved onto said one threaded end to be turned manually to push said clamping bar toward said vertical strips and clamp them against the surface of said form face, and space regulating horizontal plates spaced apart one above the other, each of which is placed across two said vertical strips and fastened thereto after the vertical strips are spaced properly.

18. An apparatus as claimed in claim 17, in which each of said regulating plates has spaced apart oblong apertures, wherein said regulating plates are fastened to said vertical strips with keys, each of said keys having a wedgeshaped portion which can pass through said oblong aperture and is extended into and engaged with said vertical strip, and a knob portion by which said wedge shaped portion is turned.

19. An apparatus as claimed in claim 16, further comprising means for connecting, a vertical post and an inclined batter, said connecting means including a toothed rod, a sleeve for insertion of said toothed rod, a fourth engaging member which has a fourth tubular housing connected to the periphery of said sleeve and radially extended therefrom, said tubular housing receiving a fourth spring loaded rod having, at its fore end, a fourth toothed face to be engaged with said toothed rod, said toothed face normally biassed backward, and a threaded member threadedly inserted into the read side of said tubular housing, said threaded member pushing said toothed face into an engaged position with said toothed rod whereby the vertical post and the inclined batter can be interconnected when the toothed rod is inserted into said sleeve and said toothed face is pushed to engage with said toothed rod.

* * * * *